US006439570B2

(12) United States Patent
Rossi et al.

(10) Patent No.: US 6,439,570 B2
(45) Date of Patent: Aug. 27, 2002

(54) BALL PLUNGER DEVICE FOR A SOCCER GAME

(75) Inventors: David Rossi, Newton; Michael Nally, Ridgewood; Seth Hochberg, Morristown, all of NJ (US)

(73) Assignee: Sportcraft, Ltd., Mt. Olive, NJ (US)

( * ) Notice: Subject to any disclaimer, the term of this patent is extended or adjusted under 35 U.S.C. 154(b) by 0 days.

(21) Appl. No.: 09/780,644

(22) Filed: Feb. 9, 2001

Related U.S. Application Data

(60) Provisional application No. 60/181,874, filed on Feb. 11, 2000.

(51) Int. Cl.[7] ..... A63F 7/06; A63F 7/07; A63F 7/24

(52) U.S. Cl. ..... 273/108.1; 273/108.52; 273/108.55; 273/119 R; 273/126 R; 273/DIG. 25; 273/129 S; 273/129 T

(58) Field of Search ..... 273/119 R, 120 A, 273/121 D, 118 A, 118 D, 129 S, 129 R, 129 T, 108.1, 108.52, 108.54, 108.56, 108.53, 108.55, 119 A, DIG. 25, 126 R; 473/178; 446/177

(56) References Cited

U.S. PATENT DOCUMENTS 1,826,641 A * 10/1931 Waddell
2,317,506 A * 4/1943 Williams
2,664,077 A * 12/1953 Moore
3,501,861 A * 3/1970 Goldfarb
3,526,991 A * 9/1970 Goldfarb
3,559,991 A * 2/1971 Immendorf
3,901,511 A * 8/1975 Garbark
4,046,286 A 9/1977 Peppard
4,148,486 A * 4/1979 Tepper
4,290,603 A * 9/1981 Barnes
5,613,683 A 3/1997 Ying et al.
5,711,522 A * 1/1998 Wiggs
6,105,961 A 8/2000 Price

* cited by examiner

*Primary Examiner*—Sebastiano Passaniti
(74) *Attorney, Agent, or Firm*—Head, Johnson & Kachigian

(57) ABSTRACT

A soccer game table comprising; a game surface having an opening therein and a plunger provided in the game surface opening, the plunger being adapted to release a game ball onto the game surface as a result of a vertical displacement of the plunger, and wherein the plunger comprises; a cylindrical cup extending into said game surface opening, the cup having an upper opening, a lower end wall, and a lower end wall bore; a piston adapted to be pushed into a depressed position in said cup, the piston including an upper surface adapted to slide within the cup, and including a stem adapted to slide through the cup lower end wall bore; a way of biasing the piston towards the cup upper opening; and a way for selectively retaining the piston in the depressed position.

8 Claims, 4 Drawing Sheets

BALL PLUNGER DEVICE FOR A SOCCER GAME

CROSS-REFERENCE TO RELATED APPLICATIONS

Priority is claimed from U.S. Provisional Patent Application Serial No. 60/181,874 filed Feb. 11, 2000 and incorporated by reference herein.

BACKGROUND OF THE INVENTION

1. Field of the Invention

The invention relates to soccer game tables, and specifically, to a mechanism or means for introducing a game ball into play.

2. Prior Art

Soccer game tables have been known for many years. In these games, a planar game surface is surrounded by a wall extending above the game surface. The game surface is typically rectangular, and marked as a soccer field is marked. Goal openings are provided at the center of each of the sidewalls extending along the short sides of the rectangular game surface.

Player rods extend across the game surface between the sidewalls extending along the long sides of the rectangular game surface. Each player rod extends through a corresponding bore provided in each of the game walls extending along the long sides of the rectangle. Typically there are a total of eight player rods, four rods for each soccer team. One or more player figures are mounted on each player rod such that the player figures are suspended above the game surface. The player rods include a handle used by a game user to both rotate the rod and the player figures mounted thereon, as well as shift the lateral position of the player figures relative to the game surface. The soccer game may be played by each game user rotating and laterally moving the rods, thereby using the player figures on the user's team to advance a game ball past the opponent's player figures and into the opponent's goal.

Play at the start of a game, or after a goal, is typically initiated in one of two ways. The game ball may simply dropped onto the center of the game surface, or the game ball may be rolled onto the game surface through an opening provided in the game wall. Each of these methods of play initiation suffers from some drawback, however.

When play is initiated by dropping the ball onto the center of the game surface, it is typically a game user who is called upon to carry out this act. Accordingly, the game user who is required to drop the ball is deprived of the use of one hand at the start of the game. This can be an extreme disadvantage considering the speed with which a skilled game user can shoot the ball into an opponent's goal. Furthermore, a ball dropped onto the game surface by hand may often miss the center mark and land closer to one of the game user's player figures. This imprecision may result in disputed goals and disgruntled game users.

When play is initiated by rolling the ball onto the game surface through an opening in the game wall, it is again the typical practice for game user to be called upon to carry out this act. If the ball rolls immediately to an opponent's player figure, the game user who initiated the game may be deprived of the use of one hand during a critical moment of play. Furthermore, intentional, or unintentional, spin of the ball as it rolls on that game surface may cause the ball to consistently roll towards one user's player figures, thereby decreasing the fairness of the game.

With respect to both hand dropping and hand rolling the ball onto the game surface, there is yet another undesirable effect. The game user who drops or rolls the game ball into play cannot help having a timing advantage. This user alone knows exactly when play will begin, and accordingly, may extract an advantage by being more prepared to begin play.

Accordingly, there is need for a method and device for initiating play on a soccer game table in a fair, consistent and neutral manner.

Applicants believe that it would be desirable to have a method and device for play initiation that allows all game user to have full use of their hands at the very beginning of a game. It would also be desirable to have a method and device for play initiation that does not permit one of the game users to influence the direction that the game ball rolls at the start of the game, or to have knowledge of the exact moment that play will begin.

SUMMARY OF THE INVENTION

Responsive to the foregoing challenges, Applicants have developed an innovative soccer game table comprising: a game surface having an opening therein; and a plunger provided in said game surface opening, said plunger being adapted to release a game ball onto the game surface as a result of a vertical displacement of said plunger.

Applicants have also developed an innovative ball plunger for a soccer game table, said plunger comprising: a cylindrical cup adapted to extend into an opening in a game table, said cup having an upper opening, a lower end wall, and a lower end wall bore; a means for securing the cup to the game table; a piston adapted to be pushed into a depressed position in said cup, said piston including an upper surface adapted to slide within said cup, and including a stem adapted to slide through the cup lower end wall bore; a spring biasing said piston towards the cup upper opening; and a suction cup connected to said stem, said suction cup being adapted to selectively retain the piston in the depressed position.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

In this respect, before explaining at least one embodiment of the invention in detail, it is to be understood that the invention is not limited in this application to the details of construction and to the arrangement so the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore that the claims be regarded as including such equivalent constructions insofar as they do not depart from the spirit and scope of the present invention.

Further, the purpose of the foregoing abstract is to enable the U.S. Patent and Trademark Office and the public generally, and especially the design engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a method and device for soccer game initiation that permits all game users to have full use of their hands at the very beginning of a game.

It is another object of the present invention to provide a method and device for soccer game initiation that prevents one of the game users from influencing the direction and speed of the ball at the start of play.

It is yet another object of the present invention to provide a method and device for soccer game initiation that reduces the ability of game user to know the exact moment that play will begin.

Additional objects and advantages of the invention are set forth, in part, in the description which follows and, in part, will be apparent to one of ordinary skill in the art from the description and/or from the practice of the invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference would be had to the accompanying drawings, depictions and descriptive matter in which there is illustrated preferred embodiments and results of the invention.

DETAILED DESCRIPTION OF THE PREFERRED EMBODIMENTS

Figure 1:
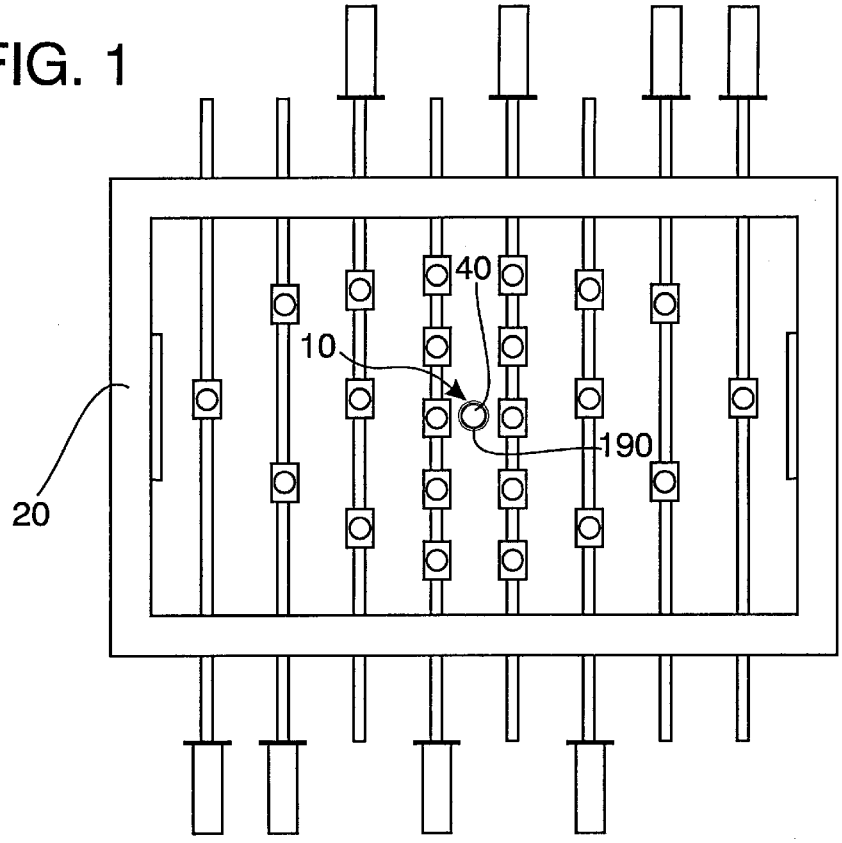
FIG. 1 is a top view of a preferred embodiment of the invention showing a soccer game table surface and a ball plunger device constructed in accordance with the present invention.

In accordance with an exemplary embodiment of the present invention as shown in the drawings and specifically in FIG. 1, reference character 10 generally designates a ball plunger device for a soccer game table 20. Again referring to the drawings and in particular to FIGS. 2 and 3, ball plunger 10 preferably includes a cup 30, a piston 40, a means for securing the cup 50, a means for biasing the piston upwards 60, and a means of selectively retaining the piston in a depressed position 70.

The plunger 10 may be disposed in an opening 80 of a game surface 90 of soccer game table 20. The edge 100 of the opening 80 is preferably aligned with the upper edge 110 of the cup 30.

The sidewall 120 of the cup 30 preferably defines a cylindrical shape so as to provide a circular upper opening 130 slightly larger than the game ball 140. The cup 30 may also include a lower end wall 145 having a central bore 150 extending therethrough. The cup 30 may generally be supported by one or more legs 160 with a preferred embodiment including but not limited to three legs. The legs 160 may be connected to the game table 20 by the engagement of the legs 160 with the recesses 170 in the lower game surface 180.

Figure 3:
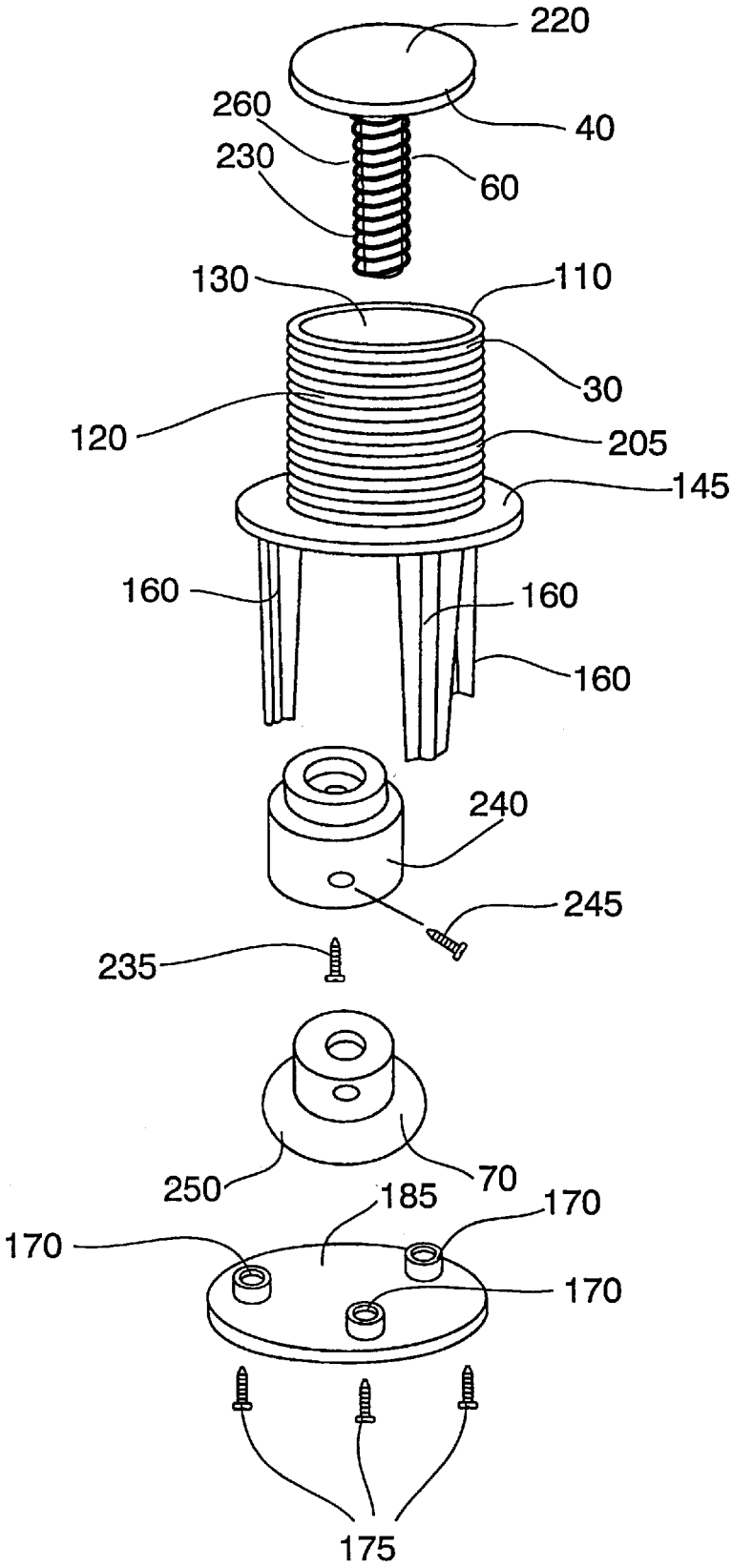
FIG. 3 is an exploded perspective partial view of a preferred embodiment of the invention.

Referring to FIG. 3 in particular, attachment plate 185 with recesses 170 included therein may also be provided to attach to lower game surface 180 by means such as but not limited to screw fasteners 175. Attachment plate 185 would allow retrofitting existing lower game surfaces 180 which may not include recesses 170.

The cup 30 may be secured in place in the game surface opening 80 by a plate 190 and a threaded nut 200. A preferred embodiment of the plate 190 is shown in an overhead plan view in FIG. 5. The plate 190 generally includes a central opening adapted to receive the upper end of the cup 30 securely. The plate 190 may be connected to the underside of the game surface 90 by fasteners 210. The threaded nut 200 may be used to adjust and secure the vertical position of the cup 30 relative to the game surface 90. The threaded nut 200 may mate with threads 205 provided on the outer surface of the cup sidewall 120. Once the threaded nut 200 abuts the plate 190, rotation of the threaded nut may result in the cup 30 being pulled downward into a recessed or even position relative to the game surface 90.

Figure 2:
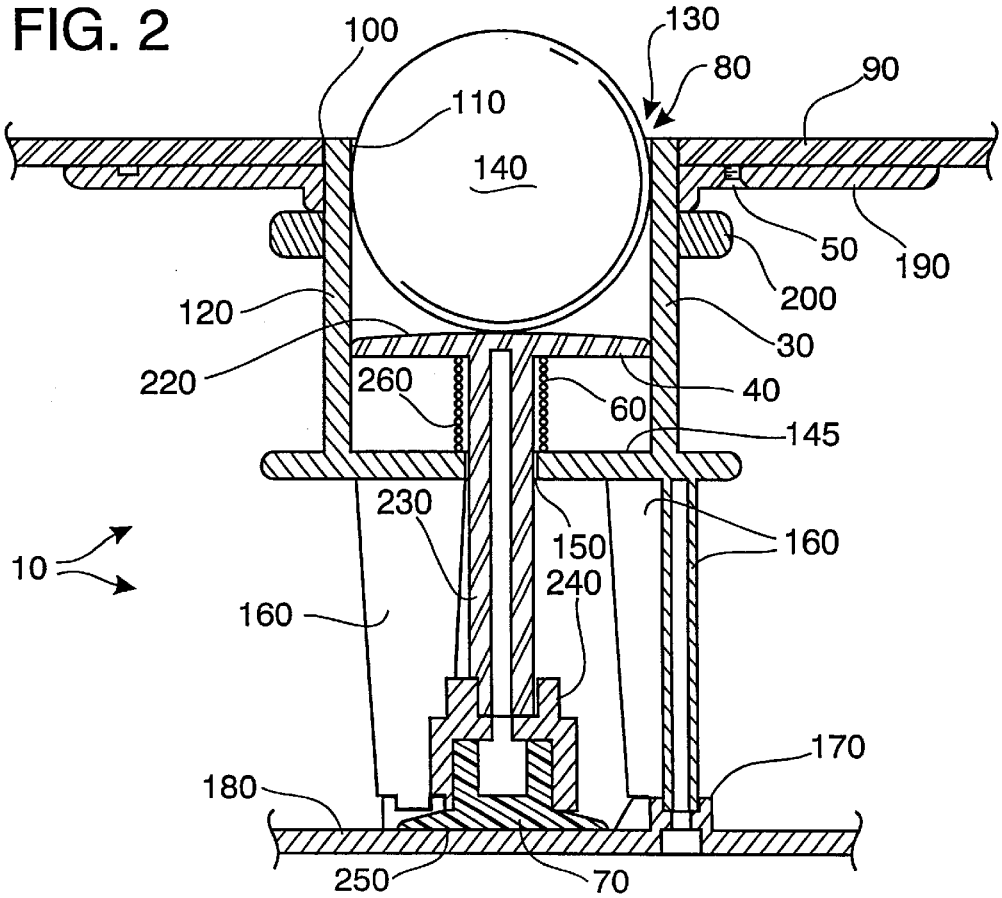
FIG. 2 is a cross-section in elevation of a preferred embodiment of the invention as shown in FIG. 1 shown with the ball plunger in a pre-play position.

A piston 40 is provided within the cup 30. The piston 40 may be adapted to be pushed into a depressed position, as generally depicted in FIG. 2, in the cup 30. The piston 40 may include an upper surface 220 adapted to support a ball 140 and slide within the cup 30, and a stem 230 adapted to slide through the cup lower end wall bore 150. The piston upper surface 220 may preferably have a slightly convex shape, although it may have a flat or other shape in alternative embodiments. A connector 240 may be attached to the bottom of the stem 230 by screw 235 or other suitable attachment means.

A preferred embodiment of a mechanism or means of selectively retaining the piston in a depressed position 70 is flexible suction cup 250 which may be attached to the connector 240 so that the piston 40, the connector 240, and the suction cup 250 may be vertically displaced as a unit. Cup 250 may be attached by screw 245 to connector 240 or other suitable means. The suction cup 250 is preferably adapted to seal to the lower game table surface 180 for a few seconds at a time, after which, the force of the spring will overcome the suction force. Furthermore, it is contemplated that means other than a suction cup 250 could be used to temporarily hold the piston 40 in a depressed position without departing from the scope of the invention.

Figure 4:
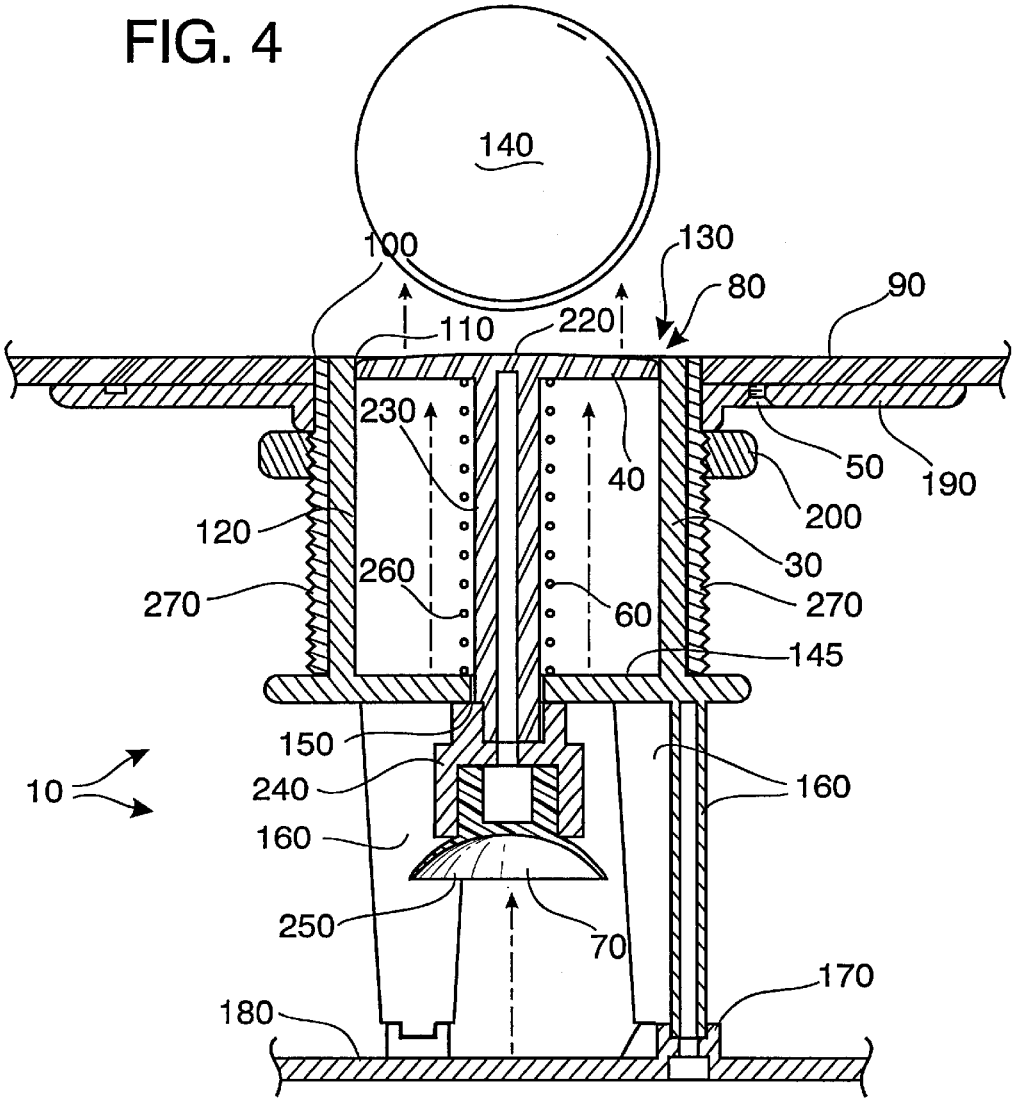
FIG. 4 is a cross-section in elevation of another embodiment of the invention shown with the ball plunger in an active play position.

A preferred embodiment of a mechanism or means for biasing the piston upwards 60 may be spring 260 which is disposed coaxially with the stem 230 between the piston upper surface 220 and the cup end wall 145. The spring 260 is selected to bias the piston 40 towards the cup upper opening 130. The spring 260 is preferably of a size that when it is fully extended, as generally shown in FIG. 4, the piston upper surface 220 is substantially even with the game surface 90. Accordingly, while the ball is in play, the upper surface is parallel and planar with the game surface.

Figure 5:
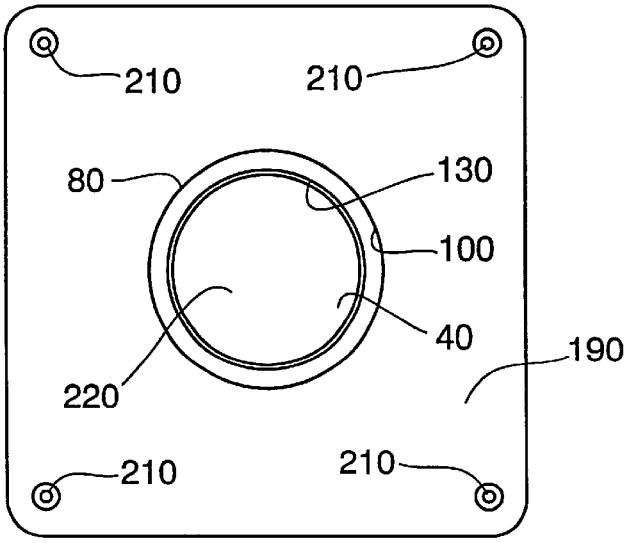
FIG. 5 is an overhead plan view of a preferred mounting plate of the invention.

With reference to FIGS. 4 and 5, in which like reference numerals refer to like elements, in another preferred embodiment of the invention, the mechanism or means for securing the cup 50 may include a plate 190, a threaded nut 200, and a sleeve 270. As in the embodiment shown in FIG. 5, the plate 190 includes a central opening adapted to receive the upper end of the cup 30. It is contemplated that there is room for sleeve 270 to be threaded and to fit between cup sidewall 120 and the edge 100 of the game surface opening 80. The sleeve 270 extends along the cup sidewall 120 such that the sleeve 270 rests on the outer portion of the cup end wall 145. The cup 30 is vertically adjusted and secured in place by the threaded nut 200. Tightening the threaded nut 200 pushes the sleeve 270 downward once the nut 200 makes contact with the plate 190. The downward displacement of the sleeve 270 results in a downward displacement of the cup 30 due to the engagement of the cup end wall 140 by the sleeve 270. This downward displacement may lock the cup 30 in place as the legs 160 become firmly engaged in the recesses 170 provided in the lower game surface 180.

Figure 6:
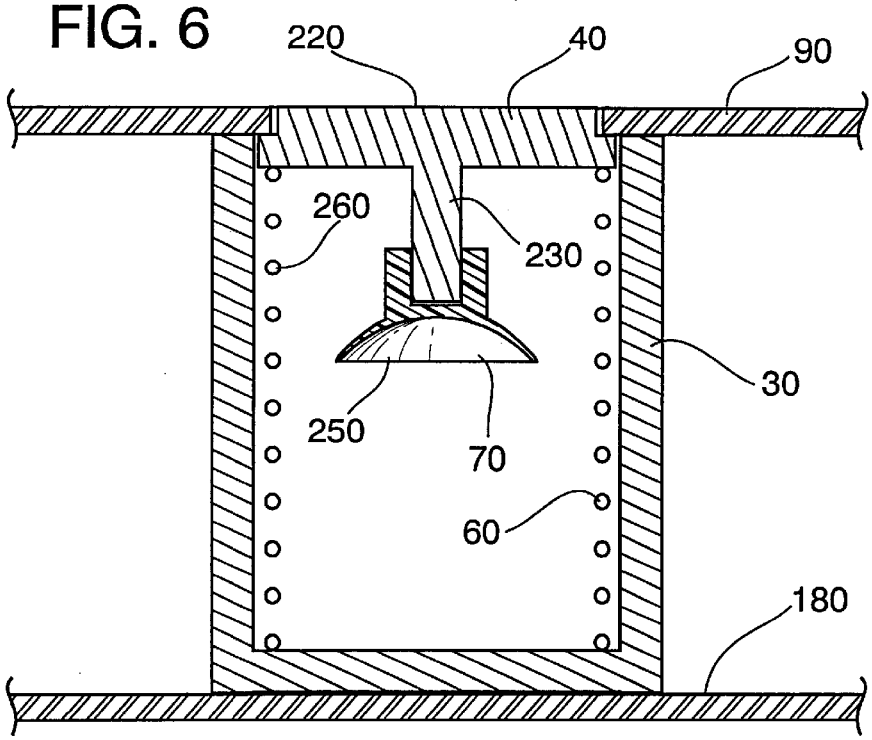
FIG. 6 is a cross-section in elevation of yet another preferred embodiment of the invention shown with the ball plunger in an active play position.

Yet another preferred embodiment of the invention is shown in FIG. 6, in which like reference numerals refer to like elements. With reference in particular to FIG. 6, unlike the previously described embodiments shown in the previous figures, the entire piston 40 is disposed in the cup 30.

Figure 7:
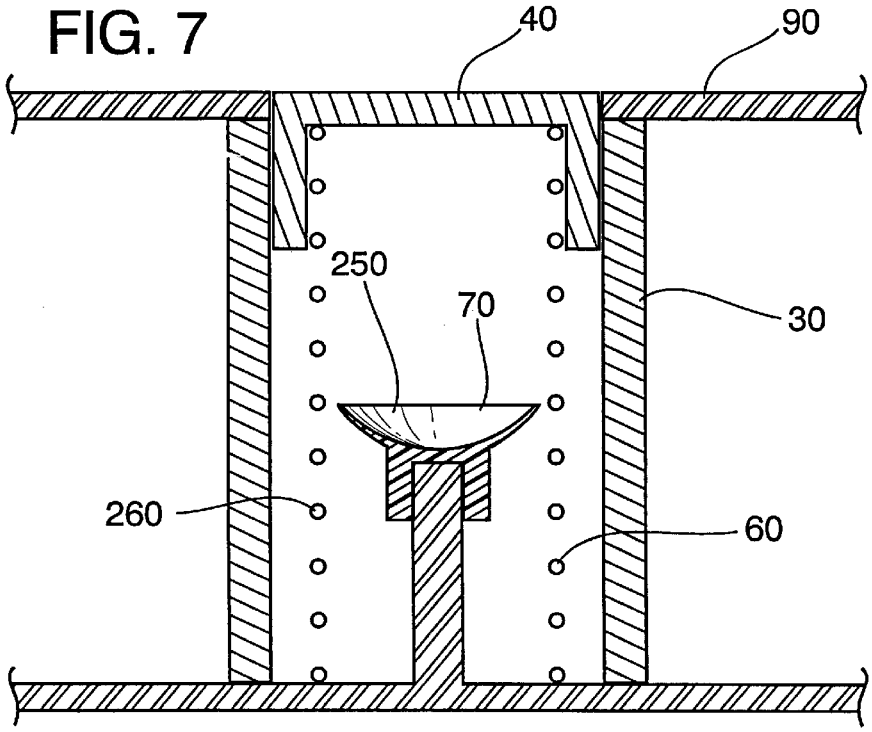
FIG. 7 is a cross-section in elevation of a still yet another embodiment of the invention shown with the ball plunger in an active play position.

Still a further preferred embodiment of the invention is shown in FIG. 7, in which like reference numerals refer to like elements. In the depicted embodiment, the piston 40 is provided as an inverted cup 30, and the suction cup 250 is attached in a fixed position to the lower game surface 180.

Each embodiment of the invention may be used to place a game ball 140 into play on a soccer game table 20. The game ball 140 may be placed on the piston 40 and depressed so that the suction cup 250 seals to the lower game surface 180. Thereafter, the bias of the spring 260 causes the seal between the suction cup 250 and the lower game surface 180 to break, which in turn allows the piston 40 to spring upward and launch the game ball 140 into play. The piston 40 comes to rest after the game ball 140 is put into play such that the upper surface 220 of the piston 40 is substantially even with the game surface 90.

It will be apparent to those skilled in the art that various modifications and variations can be made in the construction, configuration, and/or operation of the present invention without departing from the scope or spirit of the invention. For example, in the embodiments mentioned above, variations in the materials used to make each element of the invention may vary without departing from the scope of the invention. Plastic and metal elements are favored, however other materials could be used. Thus, it is intended that the present invention cover the modifications and variations of the invention provided they come within the scope of the appended claims and their equivalents.

In summary, the present invention provides a soccer game table comprising; a game surface having an opening therein; and a plunger provided in said game surface opening, said plunger being adapted to release a game ball onto the game surface as a result of a vertical displacement of said plunger.

The present invention further provides a soccer game table, wherein said plunger comprises; a cylindrical cup extending into said game surface opening, said cup having an upper opening, a lower end wall, and a lower end wall bore; a piston adapted to be pushed into a depressed position in said cup, said piston including an upper surface adapted to slide within said cup, and including a stem adapted to slide through the cup lower end wall bore; a means of biasing said piston towards the cup upper opening; and a means for selectively retaining the piston in the depressed position.

The present invention also provides a soccer game, further comprising a means for securing the cup in the game surface opening.

The present invention still further provides a soccer game wherein said means of biasing comprises a spring.

The present invention yet further provides a soccer game wherein said spring is co-axially disposed relative to said piston stem.

The present invention provides a soccer game wherein said means for selectively retaining comprises a suction cup connected to the stem.

The present invention also provides a soccer game wherein said piston upper surface is convex.

The present invention further provides a soccer game wherein said piston upper surface is substantially flat.

The present invention also provides a ball plunger of a soccer game table, said plunger comprising; a cylindrical cup adapted to extend into an opening in a game table, said cup having an upper opening, a lower end wall, and a lower end wall bore; a means for securing the cup to the game table; a piston adapted to be pushed into a depressed position in said cup, said piston including an upper surface adapted to slide within said cup, and including a stem adapted to slide through the cup lower end wall bore; a spring biasing said piston towards the cup upper opening; and a suction cup connected to said stem, said suction cup being adapted to selectively retain the piston in the depressed position.

Whereas, the present invention has been described in relation to the drawings attached hereto, it should be understood that other and further modifications, apart from those shown or suggested herein, may be made within the spirit and scope of this invention.

What is claimed is:

1. A gaming table comprising;

a game surface having an opening therein;

a cylindrical cup extending into said game surface opening, said cup having an upper opening, a lower end wall, and a lower end wall bore;

a piston having a substantially flat uppermost surface positioned along a plane substantially even with said game surface during game operation and adaptable to being pushed into a depressed position in said cup;

a means of biasing said piston towards the cup upper opening; and a means for selectively retaining said piston in a depressed position.

2. The gaming table of claim 1 wherein said piston is adapted to slide within said cup, and includes a stem adapted to slide through the cup lower end wall bore.

3. The gaming table of claim 1, further comprising a means for securing the cup in the game surface opening.

4. The gaming table of claim 1, wherein said means of biasing said piston comprises a spring.

5. The gaming table of claim 4, wherein said spring is co-axially disposed relative to said position stem.

6. The soccer game of claim 2, wherein said means for selectively retaining comprises a suction cup connected to said stem.

7. The soccer game of claim 1, wherein said piston upper surface is convex.

8. A ball plunger of a soccer game table, said plunger comprising;

a cylindrical cup adapted to extend into an opening in a game table, said cup having a upper opening, a lower end wall, and a lower end wall bore;

a means for securing the cup to the game table;

a piston having a substantially flat uppermost surface adapted to be pushed into a depressed position in said cup, said piston including an upper surface adapted to slide within said cup, and including a stem adapted to slide through the cup lower end wall bore;

a spring biasing said piston towards the cup upper opening; and a suction cup connected to said stem, said suction cup being adapted to selectively retain the piston in the depressed position.

* * * * *

UNITED STATES PATENT AND TRADEMARK OFFICE

CERTIFICATE OF CORRECTION

PATENT NO. : 6,439,570 B2
DATED : August 27, 2002
INVENTOR(S) : Rossi et al.

It is certified that error appears in the above-identified patent and that said Letters Patent is hereby corrected as shown below:

Title page, Item [54] and Column 1, lines 1 and 2,
Change the title of the application to -- BALL SERVER FOR TABLE SOCCER GAME --.

Signed and Sealed this

Nineteenth Day of November, 2002

*Attest:*

*Attesting Officer*

JAMES E. ROGAN
*Director of the United States Patent and Trademark Office*